US006138568A

United States Patent [19]

McCullough et al.

[11] Patent Number: 6,138,568

[45] Date of Patent: Oct. 31, 2000

[54] PLANOGRAPHIC PRINTING MEMBER AND PROCESS FOR ITS MANUFACTURE

[75] Inventors: Christopher D. McCullough; Kevin B. Ray, both of Leeds; Michael S. Yates, Dewsbury; Colin J. Griffiths; Mark J. Spowage, both of Leeds; Peter A. R. Bennett, Harrogate; Harjit S. Bhambra, Leeds, all of United Kingdom

[73] Assignee: Kodak Polcyhrome Graphics LLC, Norwalk, Conn.

[21] Appl. No.: 09/366,489

[22] Filed: Aug. 3, 1999

Related U.S. Application Data

[63] Continuation of application No. PCT/GB98/00266, Feb. 9, 1998.

[30] Foreign Application Priority Data

Feb. 7, 1997 [GB] United Kingdom ..... 9702568

[51] Int. Cl.[7] ..... B41C 1/10

[52] U.S. Cl. ..... 101/465; 101/455

[58] Field of Search ..... 101/453–457, 101/460, 462, 458, 459, 463.1, 465–467

[56] References Cited

U.S. PATENT DOCUMENTS

| | | | |
|---|---|---|---|
| 2,714,066 | 7/1955 | Jewett et al. | 101/456 |
| 3,181,461 | 5/1965 | Fromson | 101/456 |
| 3,470,013 | 9/1969 | Wagner | 101/453 |
| 3,640,221 | 2/1972 | Wyke | 101/453 |
| 3,963,594 | 6/1976 | Brasko | 205/658 |
| 3,971,660 | 7/1976 | Staehle | 430/18 |
| 4,052,275 | 10/1977 | Gumbinner et al. | 101/459 |
| 4,072,589 | 2/1978 | Golda et al. | 101/459 |
| 4,131,518 | 12/1978 | Fromson | 205/324 |
| 4,184,873 | 1/1980 | Noshiro et al. | 430/303 |
| 4,268,609 | 5/1981 | Shiba et al. | 430/271.1 |
| 4,330,605 | 5/1982 | Boston | 430/14 |
| 4,420,549 | 12/1983 | Cadwell | 430/158 |
| 4,457,971 | 7/1984 | Cadwell et al. | 428/323 |
| 4,542,089 | 9/1985 | Cadwell et al. | 430/276.1 |
| 4,567,131 | 1/1986 | Watkiss | 430/309 |
| 4,891,296 | 1/1990 | Tsurukiri et al. | 430/302 |
| 5,171,650 | 12/1992 | Ellis et al. | 430/20 |
| 5,339,737 | 8/1994 | Lewis et al. | 101/454 |
| 5,462,833 | 10/1995 | Hauquier et al. | 430/159 |
| 5,629,136 | 5/1997 | Higashi et al. | 430/303 |
| 5,632,204 | 5/1997 | Lewis | 101/453 |
| 5,881,645 | 3/1999 | Lenney et al. | 101/463.1 |
| 5,962,188 | 10/1999 | De Boer et al. | 430/273.1 |

FOREIGN PATENT DOCUMENTS

| | | |
|---|---|---|
| 0 028 137 | 6/1981 | European Pat. Off. . |
| 0 110 417 | 6/1984 | European Pat. Off. . |
| 0 619 524 A1 | 4/1993 | European Pat. Off. . |
| 0 620 502 A1 | 4/1993 | European Pat. Off. . |
| 0 619 525 A1 | 10/1994 | European Pat. Off. . |
| 0 653 685 A1 | 10/1994 | European Pat. Off. . |
| 0 565 006 B1 | 7/1998 | European Pat. Off. . |
| 1118009 | 3/1957 | Germany . |
| 3144657 A1 | 9/1982 | Germany . |
| 112615 | 12/1998 | Germany . |

(List continued on next page.)

OTHER PUBLICATIONS

"Hawley's Condensed Chemical Dictionary", 10th ed, G.C. Hawley Van Nostrand Reinhold, New York, 1987, pp. 1072–1073.

"Chemistry of the Elements," N.N. Greenwood and A. Eainahaw, Pergaman Press, Oxford, 1985, pp. 396 & 398.

*Primary Examiner*—Stephen R. Funk
*Attorney, Agent, or Firm*—Ratner & Prestia

[57] ABSTRACT

A planographic printing member comprising a substrate, an oleophilic layer, an infra-red sensitive/ablatable layer, and a hydrophilic layer. The hydrophilic layer is derived from a silicate solution, optionally containing particulate materials such as alumina and/or titania. The printing member may be exposed to radiation from a laser which ablates the infra-red sensitive/ablatable layer to reveal areas of the oleophilic layer. An exposed printing member may be used in wet lithographic printing.

36 Claims, 1 Drawing Sheet

FOREIGN PATENT DOCUMENTS

| | | |
|---|---|---|
| 56-84994 | 7/1981 | Japan . |
| 59-214651 | 12/1984 | Japan . |
| 61-123594 | 6/1986 | Japan . |
| 63-268642 | 7/1988 | Japan . |
| 956376 | 4/1964 | United Kingdom . |
| 1141556 | 1/1969 | United Kingdom . |
| 1196886 | 7/1970 | United Kingdom . |
| 1439127 | 6/1976 | United Kingdom . |
| 2031442 | 4/1980 | United Kingdom . |
| 1592281 | 7/1981 | United Kingdom . |
| 2069164 | 8/1981 | United Kingdom . |
| 2080964 | 2/1982 | United Kingdom . |
| 2109573 | 6/1983 | United Kingdom . |
| 2222553 | 3/1990 | United Kingdom . |
| 89/01871 | 3/1989 | WIPO . |
| 91/12140 | 8/1991 | WIPO . |
| 94/05507 | 3/1994 | WIPO . |
| 94/18005 | 8/1994 | WIPO . |
| 97/19819 | 6/1997 | WIPO . |
| 98/22853 | 5/1998 | WIPO . |

PLANOGRAPHIC PRINTING MEMBER AND PROCESS FOR ITS MANUFACTURE

CROSS-REFERENCE TO RELATED APPLICATIONS

This application is a continuation of PCT International Application PCT/GB98/00266, international filing date Feb. 9, 1998.

This invention relates to planographic printing and provides a method of preparing a planographic printing member and a planographic printing member per se. The invention particularly, although not exclusively, relates to lithographic printing.

BACKGROUND OF THE INVENTION

Lithographic processes involve establishing image (printing) and non-image (non-printing) areas on a substrate, substantially on a common plane. When such processes are used in printing industries, non-image areas and image areas are arranged to have different affinities for printing ink. For example, non-image areas may be generally hydrophilic or oleophobic and image areas may be oleophilic. In "wet" lithographic printing, a dampening or fountain (water-based) liquid is applied initially to a plate prior to application of ink so that it adheres to the non-image areas and repels oil based inks therefrom. In "dry" printing, ink is repelled from non-image areas due to their release property.

There are numerous known processes for creating image and non-image areas. Recently, much work has been directed towards processes which use laser imaging, in view of the ease with which lasers can be controlled digitally.

For example, Lewis U.S. Pat. No. 5,339,737 (Presstek) describes lithographic printing plates suitable for imaging by means of laser devices that emit in the near-infrared region. One plate described includes a substrate having an oleophilic layer, an ablatable layer over the oleophilic layer and a top hydrophilic layer. Imagewise laser exposure ablates areas of the ablatable layer which areas (together with the portions of the hydrophilic layer fixed thereto) are removed. A plate for use in wet lithographic printing which is described in Lewis U.S. Pat. No. 5,339,737 has a hydrophilic layer derived from polyvinyl alcohol which is a water-soluble polymer. As a result, the hydrophilic layer gradually dissolves into the water-based dampening or fountain solution, thereby leading to a gradual acceptance of ink by non-image areas. Consequently, the number of prints obtainable from such a plate is severely limited.

WO94/18005 (Agfa) describes a substrate coated with an ink receptive layer over which an ablatable layer is provided. A hardened hydrophilic layer comprising titania, polyvinyl alcohol, tetramethylorthosilicate and a wetting agent is provided over the ablatable layer. Disadvantageously, the hydrophilic layer needs to be hardened at an elevated temperature for a period of at least several hours and for some cases up to a week (see U.S. Pat. No. Hauquier 5,462,833) in order to provide a viable product.

SUMMARY OF THE INVENTION

It is an object of the present invention to address problems associated with known planographic printing members and methods for their preparation.

According to the invention, there is provided a method of preparing a planographic printing member comprising a support, an ablatable layer and a hydrophilic layer, said method including forming said hydrophilic layer by application of a fluid comprising a silicate.

DETAILED DESCRIPTION OF THE INVENTION

Figure 1:
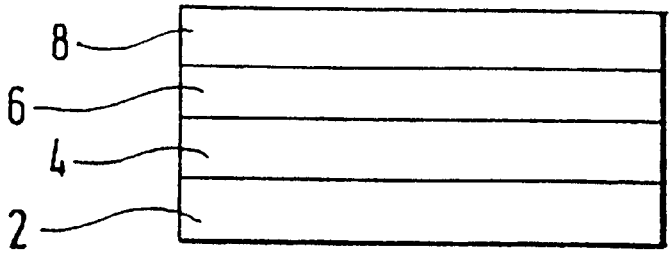
FIGS. 1–4 are schematic cross-sections of lithographic printing plates of the invention.

Preferably, said planographic printing member is a printing plate.

Said hydrophilic layer may be applied over said support, suitably so that it is between the support and said ablatable layer or it may be applied so that said ablatable layer is between the support and said hydrophilic layer. The latter described arrangement is preferred. Preferably, the planographic printing member is arranged such that, on ablation of said ablatable layer, areas of the hydrophilic layer over areas of the ablatable layer which are ablated are removed.

Said silicate preferably does not include organic functional groups, for example alkyl groups.

Said silicate is preferably substantially water soluble. Preferably, said fluid applied in said method comprises a silicate solution, suitably an aqueous silicate solution, in which said particulate material is dispersed. Said silicate solution may comprise a solution of any soluble silicate including compounds often referred to as water glasses, metasilicates, orthosilicates and sesquisilicates. Said silicate solution may comprise a solution of a modified silicate for example a borosilicate or phosphosilicate.

Said silicate solution may comprise one or more, preferably only one, metal or non-metal silicate. A metal silicate may be an alkali metal silicate. A non-metal silicate may be quaternary ammonium silicate. Preferably, said silicate is an alkaline silicate.

Said silicate solution may be formed from silicate wherein the ratio of the number of moles of Si species, for example $SiO_2$, to the number of moles of cationic, for example metal species is in the range 0.25 to 10, preferably in the range 0.25 to about 6, more preferably in the range 0.5 to 4.

Said silicate is most preferably an alkali metal silicate. In this case, the ratio of the number of moles of $SiO_2$ to the number of moles of $M_2O$ in said silicate, where M represents an alkali metal may be at least 0.25, suitably at least 0.5, preferably at least 1, more preferably at least 1.5. Especially preferred is the case wherein said ratio is at least 2.5. Said ratio may be less than 6, preferably less than 5 and more preferably less than 4.

Preferred alkali metal silicates include lithium, sodium and potassium silicates, with lithium and/or sodium silicate being especially preferred. A silicate solution comprising only sodium silicate is most preferred.

Said fluid may comprise 2 to 30 wt % of silicate (e.g. dissolved sodium silicate solid), preferably 5 to 20 wt %, more preferably 8 to 16 wt %. The fluid may be prepared using 10 to 60 wt %, preferably 30 to 50 wt %, more preferably 35 to 45 wt % of a silicate solution which comprises 30 to 40 wt % silicate.

Said fluid preferably comprises said silicate and particulate material.

Said fluid may include 5 to 60 wt % of particulate material. Preferably, the fluid includes 10 to 50 wt %, more preferably 15 to 45 wt %, especially 20 to 40 wt % of particulate material.

The ratio of the weight of silicate to the weight of particulate material in the fluid is preferably in the range 0.1 to 2 and, more preferably, in the range 0.1 to 1. Especially preferred is the case wherein the ratio is in the range 0.2 to 0.6.

Said fluid may include more than 20 wt %, preferably more than 30 wt %, more preferably more than 40 wt %, especially more than 45 wt % water (including water included in, for example said silicate solution). Said fluid may include less than 80 wt %, preferably less than 70 wt %, more preferably less than 65 wt %, especially less than about 60 wt % water.

Said particulate material may be an organic or an inorganic material. Organic particulate materials may be provided by latexes. Inorganic particulate materials may be selected from alumina, silica, silicon carbide, zinc sulphide, zirconia, barium sulphate, talcs, clays (e.g. kaolin), lithopone and titanium oxide.

Said particulate material may comprise a first material which may have a hardness of greater than 8 Modified Mohs (on a scale of 0 to 15), preferably greater than 9 and, more preferably, greater than 10 Modified Mohs.

Said first material may comprise generally spherical particles. Alternatively, said material may comprise flattened particles or platelets.

Said first material may have a mean particle size of at least 0.1 $\mu$m and preferably at least 0.5 $\mu$m.

Said first material may have a mean particle size of less than 45 $\mu$m, preferably less than 20 $\mu$m, more preferably less than 10 $\mu$m.

The particle size distribution for 95% of particles of the first material may be in the range 0.01 to 150 $\mu$m, preferably in the range 0.05 to 75 $\mu$m, more preferably in the range 0.05 to 30 $\mu$m.

Said first material preferably comprises an inorganic material. Said first material preferably comprises alumina which term includes $Al_2O_3$ and hydrates thereof, for example $Al_2O_3.3H_2O$. Preferably, said material is $Al_2O_3$.

Said particulate material in said fluid may include at least 20 wt %, preferably at least 30 wt % and, more preferably, at least 40 wt % of said first material. Said fluid may include 5 to 40 wt %, preferably 5 to 30 wt %, more preferably 7 to 25 wt %, especially 10 to 20 wt % of said first material.

Said particulate material may comprise a second material. Said second material may have a mean particle size of at least 0.001 $\mu$m, preferably at least 0.01 $\mu$m. Said second material may have a mean particle size of less than 10 $\mu$m, preferably less than 5 $\mu$m and, more preferably, less than 1 $\mu$m.

Mean particle sizes of said first and second materials suitably refer to the primary particle sizes of said materials.

Said particulate material in said fluid may include at least 20 wt %, preferably at least 30 wt % and, more preferably, at least 40 wt % of said second material. Said fluid may include 5 to 40 wt %, preferably 5 to 30 wt %, more preferably 7 to 25 wt %, especially 10 to 20 wt % of said second material.

Said second material is preferably a pigment. Said second material is preferably inorganic. Said second material is preferably titanium dioxide.

Said first and second materials preferably define a multimodal, for example a bimodal particle size distribution.

Where the fluid comprises a silicate and said particulate material comprises a first material and a second material as described, the ratio of the wt % of silicate (e.g. dissolved sodium silicate solid) to the wt % of said first material may be in the range 0.25 to 4, preferably in the range 0.5 to 1.5 and more preferably about 1. Similarly, the ratio of the wt % of silicate to the wt % of said second material may be in the range 0.25 to 4, preferably in the range 0.5 to 1.5 and more preferably about 1. The ratio of the wt % of first material to the wt % of second material may be in the range 0.5 to 2, preferably in the range 0.75 to 1.5, more preferably about 1 to 1.

Said particulate material may include a third material which is preferably adapted to lower the pH of the fluid. Said third material may be a colloid, suitably colloidal silica or an inorganic salt, suitably a phosphate, with aluminum phosphate being preferred. Where a third material is provided, preferably less than 30 wt % more preferably less than 20 wt %, especially less than 10 wt % of said particulate material is comprised by said third material.

The pH of said fluid may be greater than 9.0, is preferably greater than 9.5 and, more preferably, greater than 10.0. Especially preferred is the case wherein the pH is greater than 10.5. The pH is suitably controlled so that the silicate remains in solution and does not form a gel. A gel is generally formed when the pH of a silicate solution falls below pH9. The pH of said fluid is preferably less than 14, more preferably less than 13. The pH of the fluid is believed to be important, in some cases, for ensuring adequate adhesion of the hydrophilic layer to an underlying layer.

The fluid may include other compounds for adjusting its properties. For example, the fluid may include one or more surfactants. Said fluid may include 0 to 1 wt % of surfactant (s). A suitable class of surfactants comprises anionic sulphates or sulphonates. The fluid may include viscosity builders for adjusting the viscosity. Said fluid may include 0 to 10 wt %, preferably 0 to 5 wt % of viscosity builder(s). Also, the fluid may include dispersants for dispersing the inorganic particulate material throughout the liquid. Said fluid may include 0 to 2 wt % of dispersant(s). A suitable dispersant may be sodium hexametaphosphate.

Hydrophilic layers of planographic printing plates have been proposed which incorporate organic polymers, for example polyvinyl alcohol and/or polyvinyl acetate. Said fluid used in the method of the present invention may include less than 30 wt %, preferably less than 15 wt %, more preferably less than 5 wt %, especially less than 1 wt % of polyvinyl alcohol and/or polyvinyl acetate and/or any other organic polymeric or polymerizable material.

Said fluid may have a viscosity of less than 100 centipoise when measured at 20° C. and a shear rate of $200s^{-1}$ using a Mettler Rheomat 180 Viscometer incorporating a double gap measuring geometry. Preferably, said viscosity is less than 50 centipoise, more preferably less than 30 centipoise when measured as aforesaid. Especially preferred is the case wherein the viscosity is less than 20 centipoise.

Said fluid may be applied to said support by any suitable means which is preferably non-electrochemical.

Said fluid may be applied to both sides of said support in order to form a hydrophilic layer over both sides. A support with such a layer over both sides may be used to prepare a double-sided lithographic plate. Said fluid is preferably applied over only one side of said support.

Said fluid may be applied to form a hydrophilic layer having an average thickness after drying, of less than 20 $\mu$m, preferably less than 10 $\mu$m and, more preferably, less than 5 $\mu$m. Especially preferred is the case wherein the average thickness is less than 3 $\mu$m.

The thickness of the hydrophilic layer may be greater than 0.1 $\mu$m, preferably greater than 0.3 $\mu$m and, more preferably, greater than 0.5$\mu$m.

Said particulate material (when provided) preferably defines formations in said hydrophilic layer which render said layer non-planar.

The method preferably includes the steps of providing suitable conditions for the removal of water from the fluid after it has been applied. Suitable conditions may involve passive or active removal of water and may comprise causing an air flow over the hydrophilic layer and/or adjusting the humidity of the air. Preferably, the method includes the step of arranging the support over which said hydrophilic layer has been applied in a heated environment. Said support may be placed in an environment so that its temperature does not exceed 230° C., preferably does not exceed 200° C. and, more preferably, does not exceed 175° C. Especially preferred is the case wherein the support temperature does not exceed 150° C. The support may be arranged in the heated environment for less than 180 seconds, preferably less than 120 seconds and, more preferably, less than 100 seconds. Advantageously, it is found that no further prolonged treatment of the hydrophilic layer is needed to produce a useful printing member.

The method may include the further step of treating the hydrophilic layer with a liquid to adjust its properties. For example, the pH of the surface of the hydrophilic layer may be adjusted, for example by contacting the surface with aluminum sulphate.

Said support may be any type of support used in printing. For example, it may comprise a cylinder or a plate. The latter is preferred.

Said support may include a metal surface over which said ablatable layer and hydrophilic layer are provided. Preferred metals include aluminum, steel, tin or alloys of any of the aforesaid, with aluminum being most preferred of the aforesaid. Said metal may be provided over another material, for example over plastics or paper.

Alternatively, said support may not include a metal surface described, but may comprise plastics, for example a polyester, or a coated paper, for example one coated with a polyalkylene material, for example polyethylene.

Where the ablatable layer is provided between the support and the hydrophilic layer, an oleophilic surface is preferably defined between the support and ablatable layer, suitably so that said oleophilic surface and said ablatable layer are abutting. Said oleophilic surface may be defined by an oleophilic layer which may be a resin, for example a phenolic resin.

Said ablatable layer is suitably arranged to ablate on application of radiation, for example by means of a laser preferably arranged to emit in the infrared region and, more preferably, arranged to emit in the near-IR region, suitably between 700 and 1500 nm. Preferably, the lambda (max) of the radiation is in the range 700 to 1500 nm. Said laser may be a solid state laser (often referred to as a semi-conductor laser) and may be based on gallium aluminum arsenide compounds.

Said ablatable layer may include a first binder and a material capable of converting radiation into heat or may consist essentially of a substantially homogenous material which is inherently adapted to be ablated.

Preferred first binders are polymeric, especially organic polymers, and include vinylchloride/vinylacetate copolymers, nitrocellulose and polyurethanes.

Preferred materials for converting radiation into heat include particulate materials such as carbon black and other pigments, metals, dyes and mixtures of the aforesaid.

Said ablatable layer may include a second binder material adapted to increase the adhesion of the ablatable layer to said hydrophilic layer as compared to when said second material is not present. Said second binder material is preferably inorganic. It is preferably a material which is described herein as an essential or optional component of the hydrophilic layer. Preferably, said second binder material is a particulate material with titanium dioxide being especially preferred.

Where the ablatable layer comprises a substantially homogenous material as described, it may comprise a layer of metal. Suitable metals may be selected from aluminum, bismuth, platinum, tin, titanium, tellurium or mixtures thereof or alloys containing any of the aforesaid. Preferably, said layer of metal is selected from aluminum and titanium or alloys thereof.

The ablatable layer may have a thickness of at least 50 nm, preferably at least 100 nm, more preferably at least 150 nm, especially 200 nm or more. The ablatable layer may have a thickness of less than 10 $\mu$m, suitably less than 8 $\mu$m, preferably less than 6 $\mu$m, more preferably less than 4 $\mu$m, especially 2 $\mu$m or less.

The ablatable layer and hydrophilic layer may be contiguous.

In some cases, it may be desirable to arrange a binder layer between the ablatable and hydrophilic layers suitably for adhesion purposes. Said binder layer may comprise a polymeric, for example an organic polymeric material, optionally in combination with an inorganic material, especially an inorganic particulate material. A preferred material for said binder layer may be selected from resins, latexes and gelatin or gelatin derivatives. Said binder layer preferably includes a material which is described herein as an essential or optional component of said hydrophilic layer. Said binder layer preferably includes titanium dioxide.

In other cases, it may be desirable to treat the ablatable layer prior to providing said hydrophilic layer over said ablatable layer. Preferred treatments are arranged to modify the exposed surface of the ablatable layer and may include the use of solvent etches or a corona discharge. In some circumstances, for example when said ablatable layer comprises titanium, said ablatable layer may be subjected to a surface treatment which may comprise contacting the surface of an ablatable layer with an alkaline solution, for example comprising a metasilicate.

The invention extends to a planographic printing member preparable by the method described.

The invention further extends to a planographic printing member comprising a support, an ablatable layer and a hydrophilic layer, said hydrophilic layer comprising a material, for example a binder material, derived or derivable from a silicate.

Said binder material may be derived from at least 60 wt %, preferably at least 70 wt %, more preferably at least 80 wt %, especially at least 90 wt % silicate. Most preferably, said binder is derived essentially completely from silicate.

Said silicate may be as described in any statement herein.

Preferably, particulate material is dispersed in said binder material.

Said particulate material may be as described in any statement herein.

Preferably, 30 to 80 wt %, more preferably 40 to 70 wt %, of said hydrophilic layer is composed of said particulate material.

Said particulate material preferably includes a first material as described in any statement herein.

Said first material may have a mean particle size and/or particle size distribution as described above for said first material when in said fluid.

Said particulate material on said substrate may include at least 20 wt %, preferably at least 30 wt %, more preferably, at least 40 wt % of said first material.

Said particulate material preferably includes a second material as described in any statement herein.

Said second material may have a mean particle size and/or particle size distribution as described above for said second material when in said fluid.

Said particulate material on said substrate may include at least 20 wt %, preferably at least 30 wt %, more preferably, at least 40 wt % of said second material.

In the layer, the ratio of the wt % of first material to the wt % of second material may be in the range 0.5 to 2, preferably in the range 0.75 to 1.5, more preferably, about 1 to 1.

Said particulate material may include a third material as described in any statement herein.

Said hydrophilic layer may include less than 30 wt %, preferably less than 15 wt %, more preferably less than 5 wt %, especially less than 1 wt % of organic polymeric material.

Said hydrophilic layer preferably has an average thickness of less than 20 $\mu$m, preferably less than 10 $\mu$m and, more preferably, less than 5 $\mu$m.

Said hydrophilic layer preferably has an average thickness of greater than 0.1 $\mu$m, preferably greater than 0.3 $\mu$m, more preferably, greater than 0.5 $\mu$m.

Said hydrophilic layer may have an Ra, measured using a stylus measuring instrument (a Hommelmeter T2000) with an LV-50 measuring head, in the range 0.1 to 2 $\mu$m, suitably in the range 0.2 to 2 $\mu$m, preferably in the range 0.2 $\mu$m to 1 $\mu$m, more preferably in the range 0.3 to 0.8 $\mu$m, especially in the range 0.4 to 0.8 $\mu$m.

Said hydrophilic layer may include 1 to 20 g of material/$m^2$ of substrate. Preferably said layer includes 5 to 15 g, more preferably 8 to 12 g, of material/$m^2$ of substrate. Most preferably, said layer includes about 10 g of material/$m^2$.

It is believed that said binder material derived from a silicate of the type described contains extremely small three-dimensional silicate polymer ions carrying a negative charge. Removal of water from the system as described is believed to cause condensation of silanol groups to form a polymeric structure which includes—Si—O—Si— moieties. Accordingly, the invention extends to a planographic printing member comprising a support, an ablatable layer and a hydrophilic layer which includes a binder material comprising a polymeric structure which includes—Si—O—Si— moieties. Preferably a particulate material is arranged in said binder material.

The invention further extends to a planographic printing member comprising a support, an ablatable layer and a hydrophilic layer, wherein said ablatable layer includes a binder material adapted to increase the adhesion of the ablatable layer to the hydrophilic layer as compared to when said second material is not present.

The invention further extends to a method of preparing a planographic printing member having ink-accepting and non-ink-accepting areas, the method comprising exposing a planographic printing member as described in any statement herein to radiation to cause the ablatable layer of the member to ablate.

In a preferred embodiment, said method comprises exposing a planographic printing member comprising a support, an ablatable layer and a hydrophilic layer which includes a material derived or derivable from a silicate, to radiation which causes ablation of said ablatable layer in exposed areas.

Said radiation delivered in said method is preferably delivered using a laser. A preferred type of laser has been described above. The power output of a laser used in the method may be in the range 40 mW to 10,000 mW, suitably in the range 40 mW to 5,000 mW, preferably in the range 40 mW to 2,500 mW, more preferably in the range 40 mW to 1,000 mW, especially in the range 40 mW to 500 mW.

The invention further extends to a method of printing using a planographic printing plate as described in any statement herein, the method using a fountain fluid and ink. Thus, the method is preferably a "wet" printing method.

Any feature of any invention or embodiment described herein may be combined with any feature of any other invention or embodiment described herein.

EXAMPLES

The invention will now be described by way of example, with reference to FIGS. 1 to 4 which are schematic cross-sections through various lithographic plates.

The following products are referred to hereinafter:

BKR 2620 BAKELITE®phenolic resin—refers to a phenol-formaldehyde-cresol resin of formula $(C_7H_xO.\ C_6H_6O.\ CH_2O)_x$ obtained from Georgia-Pacific Resins Inc, Decatur, Georgia, USA.

MICROLITH®Black C-K pigment—refers to carbon black predispersed in vinyl chloride/vinyl acetate copolymer obtained from Ciba pigments of Macclesfield, England.

Luconyl Black 0066 —refers to carbon black (40 wt %) in water/butylglycol obtained from BASF Plc of Cheshire, England.

NEOREZ®R old synthetic resin—refers to a dispersion of aliphatic urethane (34 wt %) in water (47.3 wt %), N-methyl-2-pyrrolidone (17 wt %) and triethylamine (1.7 wt %) obtained from Zeneca Resins of AC-Waalwijk, Holland.

EPIKOTE®1004 synthetic resin—an epoxy resin obtained from Shell Chemicals of Chester, England.

Dispercel Tint Black STB-E—a carbon black/plasticised nitrocellulose dispersion obtained from Runnymede Dispersions Limited of Gloucestershire, England.

Nitrocellulose DHX 3–5- high nitrogen grade (11.7–12.2%) nitrocellulose in chip form, obtained from ICI Explosives of Ayrshire, Scotland.

DOWFAX®2A1surface active agent—refers to an anionic surfactant comprising a mixture of mono- and di-sulphonates from Dow Chemicals of Middlesex, England.

Titanium dioxide—refers to rutile titanium dioxide provided with an inorganic coating of $Al_2O_3$, ZnO and $ZnPO_4$. The mean crystal size is 0.23 $\mu$m. It was obtained from Tioxide (Europe) of Billingham, England.

In the figures, the same or similar parts are annotated with the same reference numerals.

Example 1

Preparation of Aluminium

A 0.3 mm gauge aluminum alloy sheet of designation AA1050 was cut to a size of 230 mm by 350 mm, with the grain running lengthways. The sheet was then immersed face up in a solution of sodium hydroxide dissolved in distilled water 100g/l at ambient temperature for 60seconds and thoroughly rinsed with water.

Example 2

Oleophilic formulation comprises a solution of BKR 2620 thermosetting phenolic resin (resole) (10 wt %) dissolved in methoxypropanol (90 wt %).

Example 3

IR sensitive/ablatable formulations

Formulation A comprises a 5 wt % dispersion of MICROLITH®Black C-K pigment in methylethylketone (95 wt %).

Formulation B comprises nitrocellulose DHX 3–5 (4.13 wt %), Dispercel Tint Black STB-E (8.10 wt %) in methylethylketone (87.77 wt %).

Formulation C comprises NEOREZ®R961 Synthetic resin (56 wt %), Luconyl Black (24 wt %) and water (20 wt %).

Formulation D comprises a dispersion of MICROLITH®Black C-K pigment (1.0 g), titanium dioxide (2.0 g) in methylethylketone (12.0 g).

Formulation E comprises a dispersion of nitrocellulose DHX 3–5 (0.7 g), Dispercel Tint Black STB-E (1.25 g), titanium dioxide (4.0 g) in methylethylketone (23.0 g).

Formulation F comprises NEOREZ®R961 Synthetic resin (3.0 g), Luconyl Black 0066 (1.25 g), titanium dioxide (4.0 g) and water (20.0 g).

Example 4

Binder formulation

Formulation G comprises EPIKOTE®1004 Synthetic resin (3 g), titanium dioxide (10 g) dispersed in methyl lactate (46.3 g) and benzyl alcohol (0.7 g).

Example 5

Hydrophilic coating formulation

Formulation H

The following reagents were used in the preparation:

Sodium silicate solution having a ratio $SiO_2 : Na_2O$ in the range 3.17 to 3.45 (average about 3.3); a composition of 27.1–28.1 wt % $SiO_2$, 8.4–8.8 wt % $Na_2O$, with the balance being water; and a density of about 75 Twaddel (°Tw), equivalent to 39.5 Baumé (°Be) and a specific gravity of 1.375.

Deionized water having a resistivity of 5 Mohm.cm $Al_2O_3$ powder comprising alumina (99.6%) in the shape of hexagonal platelets. The mean particle size is 3 $\mu$m. The powder has a hardness of 9 Moh (on a 0–10 hardness scale).

Deionized water (48 g; 24 wt %) and sodium silicate solution (80 g; 40 wt %) were added to a 250mL beaker and the solution sheared using a Silverson high shear mixer operating at maximum speed. Titanium dioxide powder (36 g; 18 wt %) was then added in portions of approximately 2 g every ten seconds. On completion of the addition, the liquid was sheared for a further two minutes. Then, alumina powder (36 g; 18 wt %) was added in portions of approximately 2 g every ten seconds. On completion of the addition, the liquid was sheared for a further two minutes. Finally, DOWFAX®2AL surface active agent (0.18 wt %) was added with stirring. The viscosity of the liquid was found to be about 10 centipoise when measured at 20° C. and a shear rate of $200s^{-1}$ using a Mettler Rheomat 180 Viscometer incorporating a double gap measuring geometry.

Preparation of Lithographic Plates

In Examples 6 to 8, lithographic plates were prepared having the construction shown in FIG. 1, wherein reference 2 represents a substrate, reference 4 represents an oleophobic layer, reference 6 represents an IR sensitive/ablatable layer and reference 8 represents a hydrophilic layer.

Example 6

An aluminum substrate, prepared as described in Example 1, was coated using a Meyer bar with the oleophilic formulation of Example 2to give a wet film weight of about 1.2 $\mu m^{-2}$ and oven-dried at 160° C. for 5 minutes to produce oleophilic layer 4.

Layer 4 was then coated using a Meyer bar with Formulation A to give a wet film weight of about 0.5 $\mu m^{-2}$ and oven-dried at 130° C. for 30 seconds to produce a layer 6.

Layer 6 was then coated using a Meyer bar with Formulation H to give a wet film weight of about 8 $\mu m^{-2}$ and oven-dried at 130° C. for 80 seconds to produce a hydrophilic layer 8. This was then post-treated by immersion in aluminum sulphate (0.1M) for thirty seconds, followed by spray rinsing with tap water and fan drying.

Examples 7 and 8

The procedure of Example 6 was followed except that Formulation B (Example 7) and Formulation C (Example 8) were used instead of Formulation A to produce an ablatable layer 4.

Figure 2:
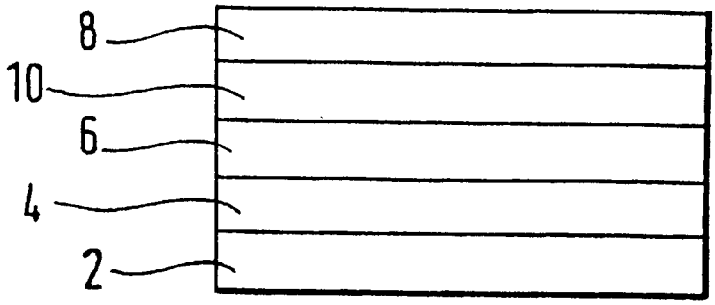

In Examples 9 to 11, lithographic plates were prepared having the construction shown in FIG. 2, wherein a binder layer 10 is arranged between layers 6 and 8 of FIG. 1.

Example 9

The procedure of Example 6 was followed except that Formulation G was coated over layer 6, before coating with Formulation H as described above to produce hydrophilic layer 8.

Examples 10 and 11

The procedure of Example 9 was followed except that Formulation B (Example 10) and Formulation C (Example 11) were used instead of Formulation A to produce an ablatable layer 4.

Figure 3:
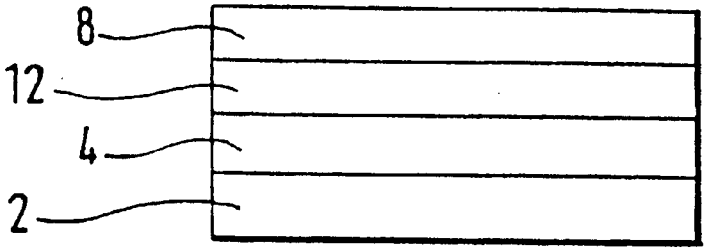

In Examples 12 to 14, lithographic plates were prepared having the construction shown in FIG. 3, wherein a layer 12 which is IR sensitive/ablatable and arranged to bind layer 8 to layer 4 is provided between layers 8 and 4.

Example 12

The procedure of Example 6was followed except that layer 4 was coated, using a Meyer bar, with Formulation D to give a wet film weight of about 2.5 $gm^{-2}$ and oven-dried at 130° C. for 30 seconds to produce layer 12 prior to coating with Formulation H to produce hydrophilic layer 8.

Examples 13 and 14

The procedure of Example 12 was followed except that Formulation E (Example 13) and Formulation F (Example 14) were used instead of Formulation D to produce layer 12.

Example 15

Figure 4:
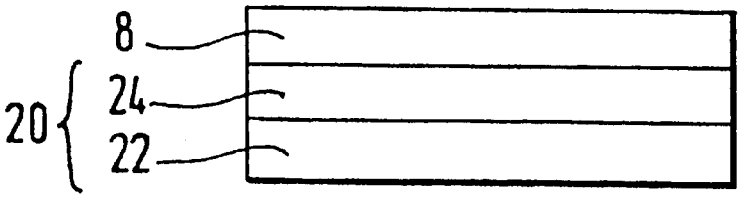

Referring to FIG. 4, an aluminized polyester film 20 comprises a polyester layer 22 and an aluminum layer 24.

Formulation H was applied over the layer 24 as described in Example 6 to produce hydrophilic layer 8.

Example 16

Imaging the lithographic plates

The plates prepared as described in Examples 6 to 15 were cut into discs of 105 mm diameter and placed on a rotatable disc that could be rotated at a constant speed of either 100 or 250 revolutions per minute. Adjacent to the rotatable disc, a translating table held a laser beam source so that it impinged normal to the disc, while the translating table moved the laser beam radially in a linear fashion with respect to the rotatable disc. The exposed image was in the form of a spiral whereby the image in the center of the spiral represented slow laser scanning speed and long exposure time and the outer edge of the spiral represented fast scanning speed and short exposure time.

The laser used was a single mode 830 nm wavelength 200 mW laser diode which was focused to a 10 micron spot. The laser power supply was a stabilized constant current source.

Example 17

Processing after Imaging

The exposed disc was immersed in fount solution which removed the imaged coating areas leaving the exposed spiral image. The larger the diameter of the resulting spiral image the less the exposure time required to form the image.

Results (i) Discs having layers of type 6, 12 and 24 can be ablated imagewise when subjected to IR radiating to produce printing plates having oleophilic image layers comprised by layer 4 (FIGS. 1 to 3) or layer 22 (FIG. 4) and hydrophilic layers comprised by layer 8.

(ii) Adhesion of layer 8 to the underlying layer is strongest for discs having a separate binder layer 10 (FIG. 2) or a binder material (e.g. titanium dioxide) incorporated in the IR sensitive/ablatable layer as in layer 12 (FIG. 3).

(iii) Discs were produced which, at a speed of 100 rpm, produced a well-defined image at up to 40 mm radius; were fully ablated at up to 7 mm radius; and accepted ink in imaged areas at up to 10 mm radius.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed:

1. A method of preparing a planographic printing member, the planographic printing member comprising a support, an ablatable layer, and a hydrophilic layer, the method comprising the step of forming the hydrophilic layer by application of a fluid comprising:

(a) water;

(b) a soluble alkali metal silicate; and (c) a particulate material; in which:

either the ablatable layer is between the support and the hydrophilic layer or the hydrophilic layer is between the support and the ablatable layer;

the soluble alkali metal silicate is in solution and the particulate material is dispersed in the fluid;

the molar ratio of $SiO_2$ to $M_2O$, in which M is an alkali metal, in the soluble alkali metal silicate is at least 2.5 and less than 6; and the fluid comprises 5 to 20 wt % of the soluble alkali metal silicate.

2. The method of claim 1 in which the ablatable layer is between the support and the hydrophilic layer.

3. The method of claim 1 in which the molar ratio of $SiO_2$ to $M_2O$ in the alkali metal silicate is less than 4.

4. The method of claim 3 in which the alkali metal silicate is sodium silicate.

5. The method of claim 4 in which the ratio of $SiO_2$ to $Na_2O$ is in the range of 3.17 to 3.45.

6. The method of claim 3 in which the ratio of the weight of the alkali metal silicate to the weight of the particulate material is 0.1 to 2.

7. The method of claim 1 in which the fluid comprises 8 to 16 wt % of the alkali metal silicate.

8. The method of claim 7 in which the ratio of the weight of the alkali metal silicate to the weight of the particulate material is 0.2 to 0.6.

9. The method of claim 8 in which the alkali metal silicate is sodium silicate.

10. The method of claim 1 in which the particulate material comprises a first particulate material that has a hardness greater than 8 Modified Mohs, based on a scale of 1 to 15, and a mean particle size of at least 0.5 $\mu$m to less than 10 $\mu$m.

11. The method of claim 10 in which the particulate material comprises 5 to 40 wt% by weight of the first particulate material.

12. The method of claim 11 in which the first particulate material is alumina.

13. The method of claim 12 in which the ratio of the weight of the alkali metal silicate to the weight of the first particulate material is 0.5 to 1.5.

14. The method of claim 13 in which the alkali metal silicate is sodium silicate.

15. The method of claim 10 in which the particulate material additionally comprises a second particulate material that has a mean particle size of at least 0.001 $\mu$m to less than 10 $\mu$m.

16. The method of claim 15 in which the particulate material comprises 5 to 40wt % by weight of the second particulate material.

17. The method of claim 16 in which the second particulate material is a pigment.

18. The method of claim 17 in which the pigment is titanium dioxide.

19. The method of claim 17 in which the particulate material comprises 5 to 40 wt % by weight of the first particulate material and the first particulate material is alumina.

20. The method of claim 19 in which the ablatable layer is between the support and the hydrophilic layer.

21. The method of claim 1 in which the viscosity of the fluid is less than 100 centipoise.

22. The method of claim 1 in which the ablatable layer comprises a binder material adapted to increase the adhesion of the ablatable layer to the hydrophilic layer as compared to when the binder material is not present.

23. The method of claim 1 in which the ablatable layer comprises a first binder which is a polymeric material.

24. The method of claim 23 in which the ablatable layer additionally comprises a second binder material adapted to increase the adhesion of the ablatable layer to the hydrophilic layer as compared to when the second binder material is not present.

25. The method of claim 24 in which the second binder material is inorganic.

26. The method of claim 1 in which the ablatable layer comprises a metal.

27. The method of claim 26 in which the metal is selected from the group consisting of aluminum, titanium, and alloys thereof.

28. The method of claim 26 in which the ablatable layer is between the support and the hydrophilic layer.

29. The method of claim 1 in which the planographic printing member additionally comprises a binder layer between the ablatable layer and the hydrophilic layer.

30. The method of claim 29 in which the binder layer comprises a first binder which is a polymeric material.

31. The method of claim 30 in which the binder layer additionally comprises a particulate material which is inorganic.

32. The method of claim 31 in which the ablatable layer is between the support and the hydrophilic layer.

33. The method of claim 32 in which the alkali metal silicate is sodium silicate.

34. The method of claim 1 in which the fluid consists essentially of water, the soluble alkali metal silicate, the particulate material, and, optionally, one or more ingredients selected from the group consisting of surfactants, viscosity builders, and dispersants, and in which the particulate material consists essentially of a first particulate material optionally, a second particulate material, and, optionally, a third material adapted to lower the pH of the fluid.

35. The method of claim 34 in which the alkali metal silicate is sodium silicate.

36. The method of claim 35 in which the ratio of $SiO_2$ to $Na_2O$ is in the range of 3.17 to 3.45.

* * * * *